United States Patent [19]

Riches

[11] 4,048,874

[45] Sept. 20, 1977

[54] HAND TOOL

[75] Inventor: Arthur John Riches, Herne Bay, England

[73] Assignee: Bunker Ramo Corporation, Oak Brook, Ill.

[21] Appl. No.: 542,141

[22] Filed: Jan. 20, 1975

[30] Foreign Application Priority Data

Jan. 21, 1974 United Kingdom ..... 02752/74

[51] Int. Cl.[2] ..... B25B 17/00

[52] U.S. Cl. ..... 81/57.31

[58] Field of Search ..... 81/58.3, 57.31; 145/50, 145/66; 74/804, 805

[56] References Cited

U.S. PATENT DOCUMENTS

| | | | |
|---|---|---|---|
| 306,375 | 10/1884 | Allen | 74/805 |
| 474,903 | 5/1892 | Cottrell | 74/805 |
| 628,094 | 7/1899 | Hooper | 74/805 |
| 2,721,591 | 10/1955 | Criswell | 81/57.31 |
| 3,580,097 | 5/1971 | Van Dalen | 145/66 |

FOREIGN PATENT DOCUMENTS

| | | | |
|---|---|---|---|
| 1,097,256 | 2/1955 | France | 74/804 |

*Primary Examiner*—James L. Jones, Jr.
*Attorney, Agent, or Firm*—F. M. Arbuckle; L. T. Steadman

[57] ABSTRACT

A hand tool having a handle and an output member mounted for rotation relative to the handle. An actuating member is mounted for rotation on the handle, and a reduction gear couples the actuating member to the output member. The reduction gear comprises a driving pinion, a restraint member permitting gyration of the pinion relative to the handle but preventing rotation thereof about its own axis, and an internally toothed annulus coaxial with and affixed to the output member and driven by said pinion. The actuating member is coupled to the pinion to cause gyration of the pinion and rotation of the output member when the actuating member is rotated relative to the handle. The tool can be used for making either coarse or fine adjustments.

9 Claims, 5 Drawing Figures

HAND TOOL

BACKGROUND OF THE INVENTION

1. Field of the Invention

The present invention relates to hand tools, such as those used to make coarse and fine adjustments on electrical or mechanical apparatus, for example, trimming potentiometers or the carburetor of an internal combustion engine.

2. Description of the Prior Art

Hitherto to make fine adjustments possible on such apparatus, it has been the practice to build into each apparatus, such as the aforementioned potentiometer, a reduction gear which reduces the rotation of an adjusting element in the apparatus sufficiently for fine variations to be effected in the setting of the apparatus. This may require a substantial number of turns of the hand tool to arrive at a coarse setting from which final fine adjustments can be made. On electrical and electronic apparatus where there are often several trimming potentiometers to be adjusted to final optimum settings before selling the apparatus or putting it into operation, adjustment of the potentiometers can take a considerable time.

A screwdriver has been proposed which can be used in the normal way and which has a reduction gear coupling a knob mounted at one end of the handle of the screwdriver to the blade projecting from the other end. By holding the handle of the screwdriver with one hand and rotating the knob with the other, the blade is made to rotate through a small angle for several turns of the knob. However, the reduction gear within this screwdriver requires precision engineering in manufacture and does not readily lend itself to inexpensive and easy production. It comprises two epicyclic gears in tandem, each gear being in the form of a cage holding planets consisting of steel balls engaging a circumferential groove in a spindle acting as the sun wheel. The cage of one gear is connected to the sun wheel of the next and threaded adjusting means are provided whereby the balls can be sufficiently urged into adequate frictional engagement with the grooves. Such a tool has the advantage, however, of enabling apparatus such a trimming potentiometers to be manufactured without the embodiment of means for enabling fine adjustments to be made.

SUMMARY OF THE INVENTION

According to the present invention there is provided a hand tool, such as a screwdriver, comprising a handle and an output member mounted for rotation relative to the handle, an actuating member mounted for rotation on the handle, and a reduction gear coupling the actuating member to the output member, the reduction gear comprising a driving pinion having a restraint permitting gyration of the pinion relative to the handle but preventing rotation thereof about its own axis, and, surrounding the pinion and in mesh therewith, an internally toothed driven annulus coaxial with and affixed to the output member, the pinion having fewer teeth than the annulus and the actuating member being so coupled to the pinion as to cause gyration of the pinion and hence progressive rotation of the output member in response to rotation of the actuating member relative to the handle. The tool can be used in the normal way for making coarse adjustments and then fine adjustments can be made by rotating the said actuating member.

In many applications, it is a drawback if both hands have to be used when making adjustments with such a hand tool in confined spaces, as would be the case when using the aforementioned proposed screwdriver.

According to a first feature of the invention, the actuating member of the hand tool is located at the same end of the handle of the hand tool as that on which the output member is mounted for rotation. Thus, by holding the handle of the hand tool in the palm of the hand and turning the actuating member with, say, the thumb and forefinger of that hand, the considerable advantage is obtained of single-handed operation of the hand tool, leaving the other hand free to control instruments associated with the apparatus being adjusted.

According to a second feature of the invention, the actuating member of the hand tool is coaxial with the output member and the coupling between the actuating member and the pinion of the reduction gear comprises co-operating complementary eccentric surfaces on the pinion and the actuating member. Preferably, the co-operating complementary eccentric surfaces comprise a boss on the pinion which fits into an eccentric bore in the actuating member.

According to a third feature of the invention, the restraint which prevents rotation of the pinion about its own axis but which permits gyration thereof relative to the handle, comprises a restraining member which is located between the pinion and the handle and which is engaged on one side with the pinion and on the other side with the handle by respective mating transverse slot and peg arrangements, the axes of the two transverse slots intersecting at right angles to one another when viewed in the axial direction of the output member. Preferably, on the pinion side the slot is in the pinion and the peg on the restraining member and on the handle side the slot is in the restraining member and the peg is on the handle.

According to a fourth feature of the invention, the actuating member of the hand tool comprises a substantially tubular sleeve which is coaxial with the output member. The actuating member is mounted for rotation preferably with the rear end of the actuating member fitting over a boss projecting from the handle and with the front end of the actuating member fitting over and being borne by the outer surface of the internally toothed annulus. The actuating member may be knurled around its periphery to provide a better grip and it can also be of the same diameter as the handle so that the hand tool is of uniform dimension from the knurled part of the actuating member to the rear end of the handle.

According to a fifth feature of the invention, the internally toothed annulus, the pinion, and the restraining member of the reduction gear are all contained within the tubular actuating member.

Thus, with the working parts of the hand tool enclosed within the actuating member, the hand tool can assume the shape of, for example, a screwdriver with a cylindrical handle, the only difference being a knurled rotatable sleeve at the front end of the handle of the hand tool.

According to a sixth feature of the invention, a shaft extends rearwardly from the output member through a bore in the pinion, the restraining member and the handle, and is made captive at the rear end of the handle to hold the assembly together.

BRIEF DESCRIPTION OF THE DRAWINGS

The present invention will now be described, by way of example, with reference to the accompanying drawings in which.

DESCRIPTION OF THE PREFERRED EMBODIMENTS

Figure 1:
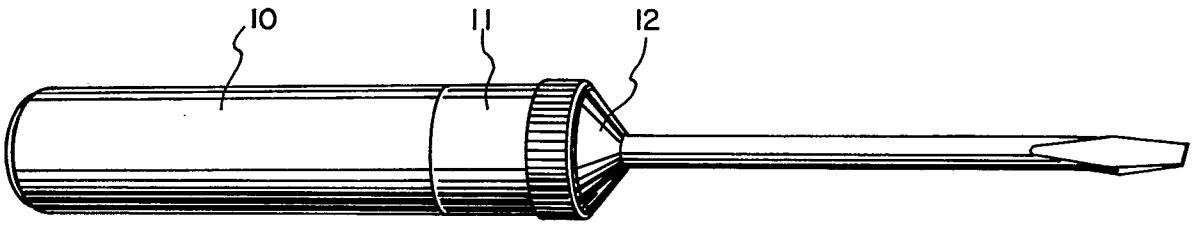
FIG. 1 shows one embodiment of the invention, in the form of a screwdriver.
Figure 2:
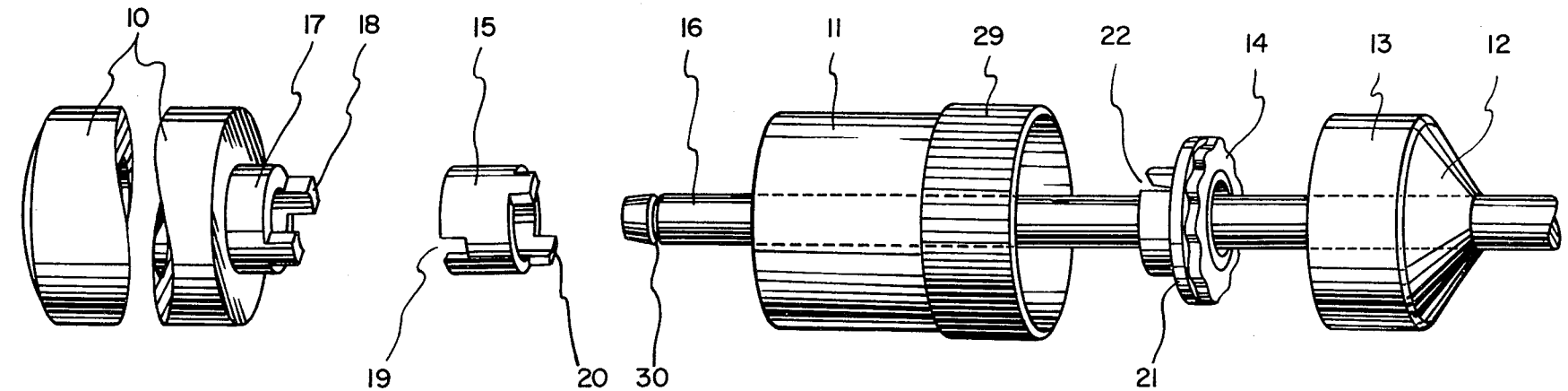
FIG. 2 shows to an enlarged scale an expanded view of reduction gear in the hand tool of FIG. 1.

With reference to FIGS. 1 and 2, the hand tool shown includes a handle 10, an actuating member 11 and an output member 12. Affixed coaxially to the output member 12 is a driven, internally-toothed annulus 13 which surrounds and is in mesh with a driving pinion 14 which has fewer teeth than the annulus. Located between the driving pinion and the handle is a restraining member 15. Shown passing rearwardly from the output member 12 through the actuating member 11 and a bore in the pinion 14, is a shaft 16 which also passes, on assembling the parts of FIG. 2, through a bore in the restraining member 15 and the handle 10.

Also shown in FIG. 2 is a boss 17 on the front end of the handle 10 with pegs 18 projecting therefrom. The restraining member 15 has on one side a transverse slot 19 and, on the other side, projecting pegs 20. Projecting rearwardly from the pinion 14 is a boss 21 in which there is a further transverse slot 22.

Figure 3:
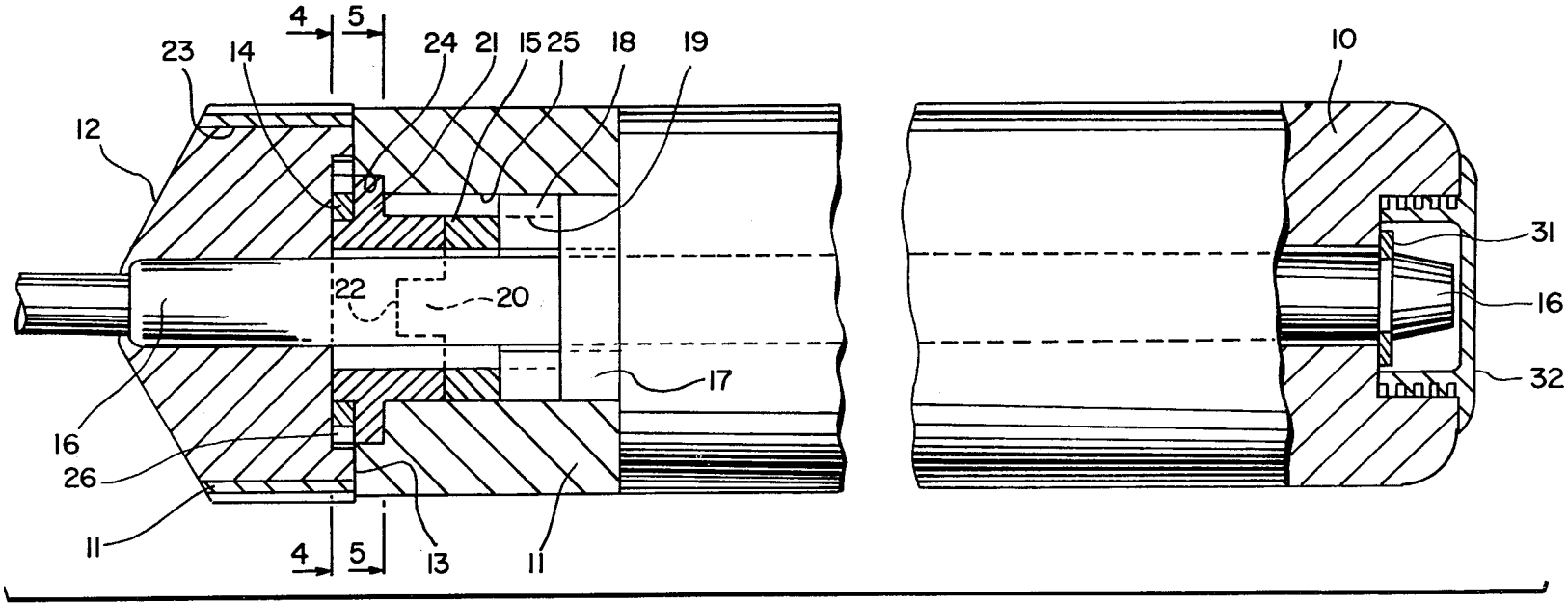
FIG. 3 shows a side elevation partly in section of the embodiment of FIG. 1.
Figure 4:
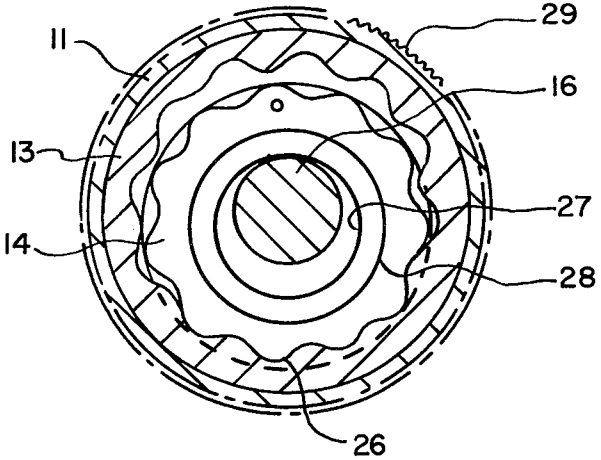
FIGS. 4 and 5 are cross sectional views taken along the lines 4—4 and 5—5 in FIG. 3.

The way in which the parts of the reduction gear of FIG. 2 fit together will now be described with reference to FIG. 3. The internally toothed annulus 13 fits into a bore 23 in the actuating member 11. The pinion 14 is located eccentrically within the annulus by means of its boss 21 which is received by an eccentric bore 24 in the actuating member. The restraining member 15 is located between the pinion and the handle within a further, coaxial bore 25 in the actuating member. The pegs 18 projecting from the handle engage the transverse slot 19 in the restraining member and the projecting pegs 20 on the restraining member engage the transverse slot 22 in the boss 21 on the pinion 14. The engagement of the slots with the pegs is such that, when the two transverse slots are viewed in the axial direction of the shaft 16, the axes of the slots intersect at right angles to one another. The actuating member surrounds all the reduction gear, its rear being borne by the boss 17 projecting from the handle. In FIGS. 3 and 4, the teeth of the pinion and the annulus are shown meshing at 26.

Referring to FIG. 4, the pinion 14 can be seen lying eccentrically within the annulus 13 which lies coaxially within the actuating member 11. The outlines of the inner and outer surfaces of part of the boss on the pinion 14 are shown at 27 and 28 and the shaft 16 is shown lying coaxially within the annulus and actuating member. The front end of the actuating member is knurled to provide a better grip, as shown in FIGS. 2 and 4 at 29.

Figure 5:
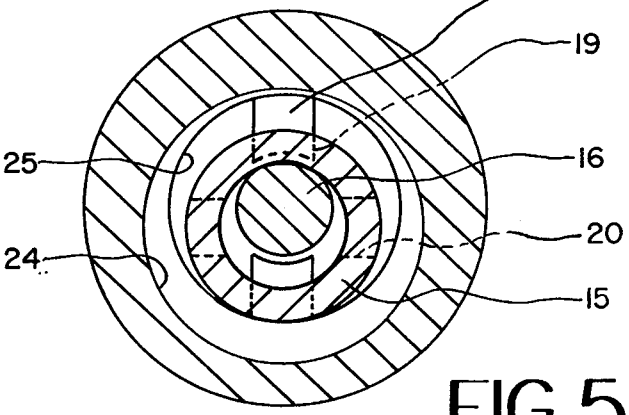

Referring to FIG. 5, the eccentric bore in the actuating member which receive the boss of the pinion is shown at 24 and the bore in which the restraining member lies is shown at 25. The Figure also shows a rearward view from the line 5—5 in FIG. 3, in which the projecting pegs 18 on the boss on the handle can be seen engaging with the slot 19 in the restraining member 15. The projecting pegs on the restraining member are shown at 20.

The rear of the handle of the hand tool is shown in FIG. 3 with the shaft 16 projecting therethrough, there being engaged in a groove in the shaft, shown in FIG. 2 at 30, a circlip 31, which holds the shaft captive at its rear end. A closure 32 may be provided for decorative purposes.

The action of the reduction gear of the hand tool will now be described with reference to FIGS. 2 and 3. On rotating the actuating member 11 relative to the handle 10, the pinion 14 is caused to gyrate within the internally toothed annulus 13 by means of its boss 21, which is located within the eccentric bore 24 in the actuating member, the pinion being prevented from rotation about its own axis by means of the restraining member 15. This causes progressive rotation of the annulus and the output member 12.

The restraining member accommodates the movement of the pinion the center of which follows a circular path around the center of the annulus, by means of the mating transverse slot and peg arrangements on either side thereof. The restraining member is free to reciprocate laterally on the pegs 18 and the pinion is free to reciprocate laterally, and at right angles, on the pegs 20. Thus, the combination of the lateral movements perpendicular to one another enable the pinion to move anywhere within the annulus, but at the same time stop its rotation relative to the handle. It will be appreciated that the bore 25 in the actuating member 11 is large enough to accommodate the lateral movement of the restraining member.

From the foregoing, it will be seen that the hand tool comprises only six main parts, all of which can be made from molded plastic. To assemble the hand tool, the pinion, the actuating member, and the restraining member are slipped on the shaft extending rearwardly from the output member, which is then inserted into the bore in the handle and made captive at its rear end by means of a circlip. Thus, production of the hand tool can be both inexpensive and easy.

The hand tool can be used in the normal way for making coarse adjustments and then final fine adjustments can be made by rotating the actuating member. Thus, the reduction gear which was previously embodied in each apparatus to enable fine adjustments to be made by ordinary hand tools can be dispensed with. Also such adjustments can be speeded up as a coarse setting from which final fine adjustments are to be made can be arrived at quickly.

The torque that can be exerted by the output member of the hand tool before slipping occurs can be quite considerable. This enables the friction of locking means, such as lock nuts, that is used to stop the adjusting element on the apparatus to be adjusted from slipping, to be sometimes directly overcome. Thus the speed with which the apparatus can be adjusted is further increased. This also overcomes the well known disadvantage that on securing the adjusting element with the locking means, the adjusting element is almost invariably moved from its final setting.

Instead of having a blade projecting from the output member as shown in the accompanying drawings, a collet may be provided into which a variety of different adjusting members can be inserted. It will be appreciated that the number of teeth on the annulus and the pinion can be chosen to provide the most suitable reduction ratio for any particular use of the hand tool.

The embodiments of the invention in which an exclusive property or privilege is claimed are defined as follows:

1. A clutchless hand tool, adaptable for use for manipulation with but one hand, for selectively making coarse and fine adjustments comprising:

a handle;

an output member coupled to said handle for axial rotation relative to said handle;

an actuating member mounted on said handle for axial rotation relative to said handle; and a reduction gear means coupling said actuating member to said output member, said output member including a coaxial shaft which extends from the output member through a bore in said gear means and through a bore in said handle where it is restrained, whereby coarse adjustments of said hand tool can be performed by rotating said tool with said one hand, and whereby fine adjustments of said hand tool can be performed by holding said handle, against rotation, with said one hand, while simultaneously rotating said actuating member with at least one finger of said one hand.

2. The clutchless hand tool as recited in claim 1, wherein said actuating member is located adjacent the same end of said handle as said output member.

3. The clutchless hand tool as recited in claim 2, wherein the actuating member is coaxial with the output member.

4. The clutchless hand tool as recited in claim 3, wherein said handle has a coaxial boss projecting toward said output member and said actuating member comprises a tubular sleeve with one end mounted on said boss coaxially with said output member and the other end extending over and borne by a portion of said output member.

5. The clutchless hand tool as recited in claim 1, wherein said reduction gear means is contained within said actuating member.

6. A clutchless hand tool, adaptable for use for manipulation with but one hand, for selectively making coarse and fine adjustments comprising:

a handle;

an output member coupled to said handle for axial rotation relative to said handle;

an actuating member mounted on said handle for axial rotation relative to said handle; and a reduction gear means coupling said actuating member to said output member, whereby coarse adjustments of said hand tool can be performed by rotating said tool with said one hand, and whereby fine adjustments of said hand tool can be performed by holding said handle, against rotation, with said one hand, while simultaneously rotating said actuating member with at least one finger of said one hand, said reduction gear means comprising a driving pinion, a restraining means coupled to said pinion and permitting gyration of said pinion relative to the axis of said handle but preventing rotation of said pinion about its own axis, and an internally toothed annulus affixed coaxially to said output member and driven by said pinion, said annulus having more teeth than said pinion; and said actuating member being coupled to said pinion so that rotation of said actuating member relative to said handle causes gyration of said pinion thereby progressively rotating said output member at a lower rate than does rotation of said handle.

7. The clutchless hand tool as recited in claim 6, wherein said restraining means comprises a restraining member located between said pinion and said handle, said restraining member being engaged on one side with said pinion and on the other side with said handle by respective mating transverse slot and peg couplings, the axis of said respective couplings being at right angles to each other about the axis of said output member.

8. The clutchless hand tool as recited in claim 7, wherein said coupling on the pinion side of said restraining means comprises a slot in said pinion and a peg on said restraining member, and said coupling on the handle side of said restraining means comprises a slot in said restraining member and a peg on said handle.

9. A clutchless hand tool, adaptable for use for manipulation with but one hand, for selectively making coarse and fine adjustment comprising:

a handle;

an actuating member having a rear end mounted on a front end of said handle for axial rotation relative to said handle, said actuating member having an eccentric bore parallel to its axis and adjacent its front end;

an output member located adjacent said front end of said actuating member for axial rotation relative to said handle; and a reduction gear means coupling said actuating member to said output member, said gear means having a boss fitted into said eccentric bore, whereby rotation of said actuating member relative to said handle causes gyration of said reduction gear means thereby progressively rotating said output member at a lower rate than does rotation of said handle, wherein said reduction gear means comprises:

a driving pinion having said boss;

a restraining means coupled to said pinion and permitting gyration of said pinion relative to the axis of said handle but preventing rotation of said pinion about its own axis; and an internally toothed annulus affixed coaxially to said output member, and driven by said pinion, said annulus having more teeth than said pinion; and wherein said restraining means comprises a restraining member located between said pinion and said handle, said restraining member being engaged on one side with said pinion and on the other side with said handle by respective mating transverse slot and peg couplings, the axis of said respective couplings being at right angles to each other about the axis of said output member, whereby coarse adjustments of said clutchless hand tool can be performed by rotating said tool with said one hand, and whereby fine adjustments of said hand tool can be performed by holding said handle, against rotation, with said one hand, while simultaneously rotating said actuating member with at least one finger of said one hand.

* * * * *